US008925155B2

(12) United States Patent
Grudzien et al.

(10) Patent No.: US 8,925,155 B2
(45) Date of Patent: Jan. 6, 2015

(54) REMOVABLE HANDRAIL ASSISTANCE DEVICE

(71) Applicants: Michael Joseph Grudzien, Erie, PA (US); Ray Polanski, Erie, PA (US)

(72) Inventors: Michael Joseph Grudzien, Erie, PA (US); Ray Polanski, Erie, PA (US)

( * ) Notice: Subject to any disclaimer, the term of this patent is extended or adjusted under 35 U.S.C. 154(b) by 148 days.

(21) Appl. No.: 13/771,481

(22) Filed: Feb. 20, 2013

(65) Prior Publication Data

US 2013/0299762 A1 Nov. 14, 2013

Related U.S. Application Data

(63) Continuation-in-part of application No. 29/414,565, filed on May 11, 2012, now abandoned.

(51) Int. Cl.

| | |
|---|---|
| ***A45C 13/22*** | (2006.01) |
| ***B60B 7/00*** | (2006.01) |
| ***B25G 1/10*** | (2006.01) |
| ***E04F 11/18*** | (2006.01) |

(52) U.S. Cl.

CPC ..... *E04F 11/1808* (2013.01)
USPC ..... 16/436; 16/422; 16/426; 16/110.1

(58) Field of Classification Search

CPC ... A47K 3/003; A47K 17/022; A47K 17/024; A60G 7/053; A61G 5/14; A61G 7/1044; A61G 2200/30; A61G 2200/34; A61G 2200/36; A61G 7/1038; B60N 3/02; B60N 3/026; E05B 1/0053
USPC ..... 16/110.1, 413, 422, 426, 430, 436, 16/DIG. 40, DIG. 41; 5/662, 425, 428, 5/84.1, 503.1; 4/576.1, 577.1, 604; 52/29; 211/105.1, 123, 16, 105.2; 294/15; 248/251, 274.1, 279.1
See application file for complete search history.

(56) References Cited

U.S. PATENT DOCUMENTS

| | | | | |
|---|---|---|---|---|
| 1,389,477 | A | | 8/1921 | Beeman |
| 2,238,513 | A | | 4/1941 | Ward |
| 3,121,907 | A | | 2/1964 | Stebbins |
| 4,048,471 | A | * | 9/1977 | Ours ..... 219/228 |
| D286,015 | S | | 10/1986 | Johnson |
| 4,626,016 | A | * | 12/1986 | Bergsten ..... 296/1.02 |
| 4,686,742 | A | | 8/1987 | Arnold |
| D295,717 | S | | 5/1988 | Driscoll |
| 4,817,239 | A | | 4/1989 | Campbell et al. |
| 4,926,965 | A | * | 5/1990 | Fox ..... 182/89 |
| 5,337,430 | A | * | 8/1994 | Schlein ..... 5/662 |
| 5,658,026 | A | | 8/1997 | Nigro et al. |
| D384,569 | S | | 10/1997 | Simon et al. |
| D407,299 | S | | 3/1999 | McCreary |

(Continued)

FOREIGN PATENT DOCUMENTS

| | | | |
|---|---|---|---|
| GB | 2459791 | A | * 11/2009 |
| JP | 10314247 | A | * 12/1998 |

(Continued)

*Primary Examiner* — Chuck Mah
(74) *Attorney, Agent, or Firm* — Kenneth C. Spafford

(57) ABSTRACT

A removable handrail assistance device includes a bracket and a handle extension. The bracket may be affixed to a wall or other essentially immobile structure. The handle may be easily inserted into, or removed from, the bracket. The inserted handle extension is capable of supporting a user who holds onto the handle for support while, for example, climbing up or down one or more stairs.

16 Claims, 8 Drawing Sheets

(56) References Cited

U.S. PATENT DOCUMENTS

| | | | | |
|---|---|---|---|---|
| 6,163,894 | A | 12/2000 | Simonds | |
| 6,189,183 | B1 | 2/2001 | Hartselle | |
| 6,276,027 | B1 * | 8/2001 | Hanna | 16/436 |
| 6,340,189 | B1 * | 1/2002 | Pordy | 296/1.02 |
| 6,708,887 | B1 * | 3/2004 | Garrett et al. | 235/462.45 |
| 6,799,353 | B1 * | 10/2004 | Stewart | 16/422 |
| D511,083 | S | 11/2005 | Gurzenda et al. | |
| 6,961,972 | B2 * | 11/2005 | Pendell | 5/662 |
| 6,986,177 | B2 * | 1/2006 | Thaxton | 5/81.1 R |
| 7,039,971 | B2 * | 5/2006 | Sebastien | 5/662 |
| D539,113 | S | 3/2007 | Fulkerson | |
| D569,222 | S | 5/2008 | Lee | |
| 7,624,966 | B2 * | 12/2009 | Dando et al. | 254/131 |
| 7,744,141 | B2 * | 6/2010 | Saionji et al. | 296/1.02 |
| D637,885 | S | 5/2011 | Buck | |
| D658,029 | S | 4/2012 | Fulkerson et al. | |
| 2006/0230540 | A1 * | 10/2006 | Whelan | 5/662 |
| 2012/0133168 | A1 * | 5/2012 | Ardigo | 296/1.02 |
| 2013/0326845 | A1 * | 12/2013 | Hinkle | 16/429 |

FOREIGN PATENT DOCUMENTS

| | | | |
|---|---|---|---|
| JP | 2003089491 | A * | 3/2003 |
| JP | 2009191571 | A * | 8/2009 |
| JP | 2010053581 | A * | 3/2010 |

* cited by examiner

REMOVABLE HANDRAIL ASSISTANCE DEVICE

CROSS-REFERENCE TO RELATED APPLICATIONS

This nonprovisional utility application is a continuation-in-part of design patent application Ser. No. 29/414,565, filed May 11, 2012.

FIELD OF THE INVENTION

This disclosure is directed to a device and assembly that is a removable handrail extension, to be located, for example, at the top or bottom of stairs.

The device allows the user to grip the stable handle portion of the device while climbing up or down a step, or in other situations where a steady handle might be useful, e.g., getting out of bed, using the lavatory, or walking across a slippery surface.

BACKGROUND AND SUMMARY OF THE INVENTION

Persons who have difficulty climbing up or going down stairs will often need the assistance of a handrail. However, a stair handrail will ordinarily only extend as far as the last step before a landing or floor. Handrails usually cannot extend farther, either for aesthetic reasons, or for safety reasons, e.g., an extra-long handrail might be a dangerous protrusion.

Thus, a person who needs a handrail for every stair step will often have difficulty taking the first or last step on a set of stairs due to the lack of any rail or other sturdy object to hold onto.

Thus, there exists a need for a removable handrail that can be easily inserted and removed from a relatively unobtrusive bracket, where the handrail is positioned, for example, to be used for additional threshold support at the first or last step on a set of stairs.

In the displayed embodiment, the device comprises a bracket and a handle. In this embodiment, the proximal, connector, and distal portions and sides of the handle are positioned substantially at right angles to each other. Components of the bracket are likewise at substantially right angles to one another and designed to receive the handle at right angles. As a result, when the handle is inserted into the bracket the handle is immobilized in virtually all directions in which a user might exert a force vector upon the handle during use. The handle can be easily removed because an inserted handle is not prevented from being lifted directly upward, and directly upward is the one direction in which a user is extremely unlikely to push during use.

Directional terms such as "right" and "left" in this disclosure and in the claims are only used to explain the relative positions of elements and parts, and are not absolute. For example, "right" and "left" might be reversed in this disclosure if the bracket were designed such that the terminal end of the handle were to point right rather than left.

Various changes, alternatives and modifications will become apparent to one of ordinary skill in the art following a reading of this specification and a review of the drawings. It is intended that any such changes, alternatives and modifications as fall within the scope of the appended claims be considered part of the present invention.

DETAILED DESCRIPTION

Figure 1A:
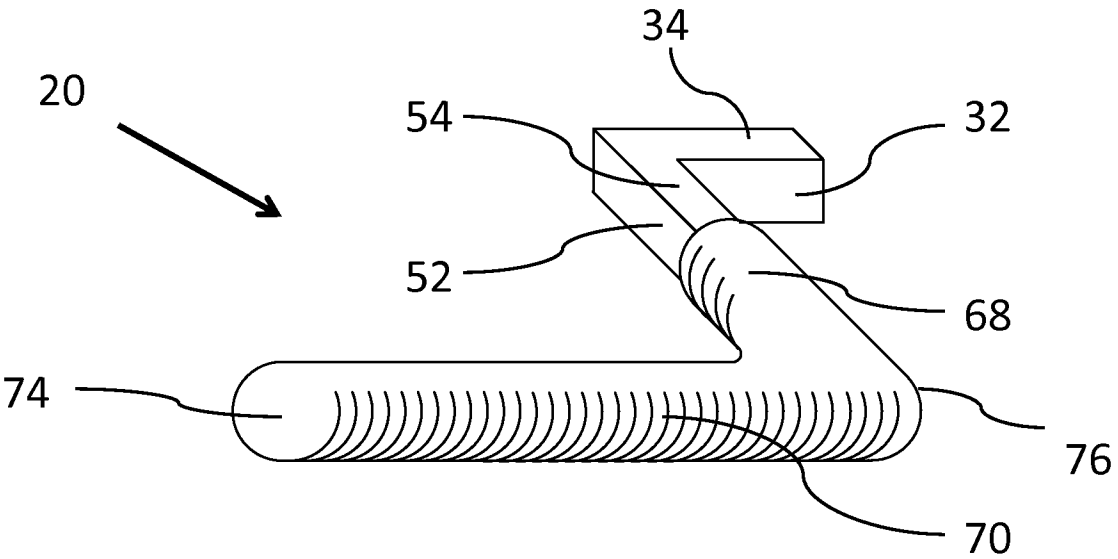
FIG. 1A is a front perspective view of the handle portion of an embodiment of the device.
Figure 1B:
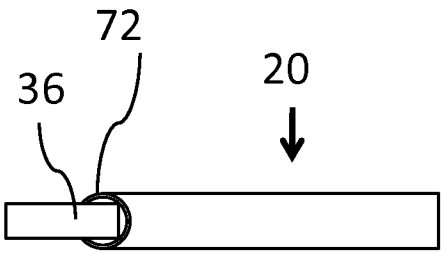
FIG. 1B is a rear view of the handle of FIG. 1A.
Figure 1C:
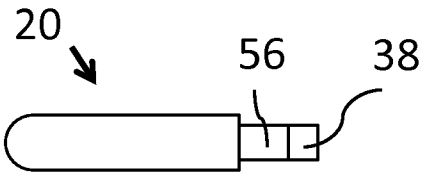
FIG. 1C is a right side view of the handle of FIG. 1A.
Figure 1D:
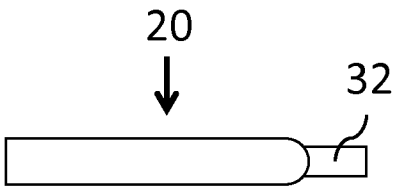
FIG. 1D is a front view of the handle of FIG. 1A.

Referring first to FIGS. 1A, 1B, 1C, 1D, 1E, and 1F, the displayed embodiment 10 includes a handle 20. The handle 20 can be made of a strong material such as steel. The distal gripping portion 70 of the handle may be cylindrical and may include a wrap or cover 72 of foam, for example.

Handle proximal top side 34 and proximal bottom side 40 are adjacent and perpendicular to proximal front side 32 and proximal back side 36. Handle proximal end side 38 is adjacent and perpendicular to proximal top, bottom, front, and back sides 34, 40, 32, 36.

Handle connector left side 52 is adjacent and perpendicular to handle proximal back side 36. Connector right side 56 is adjacent to perpendicular to proximal front side 32.

Figure 1F:
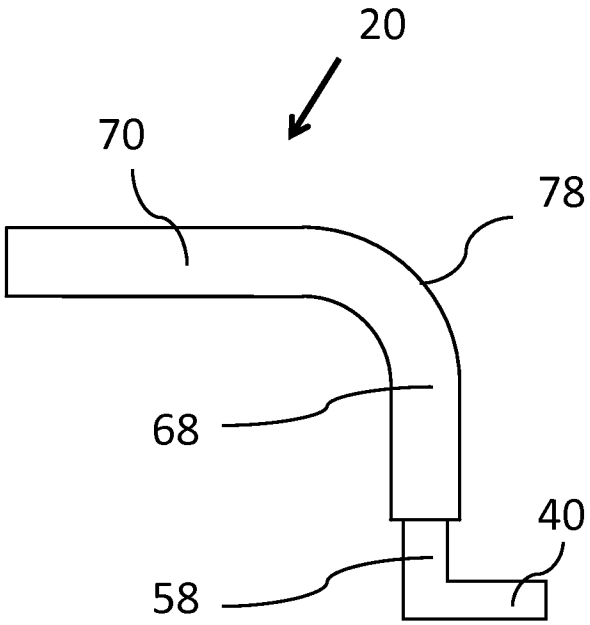
FIG. 1F is a bottom view of a variation of the handle of FIG. 1A.
Figure 1E:
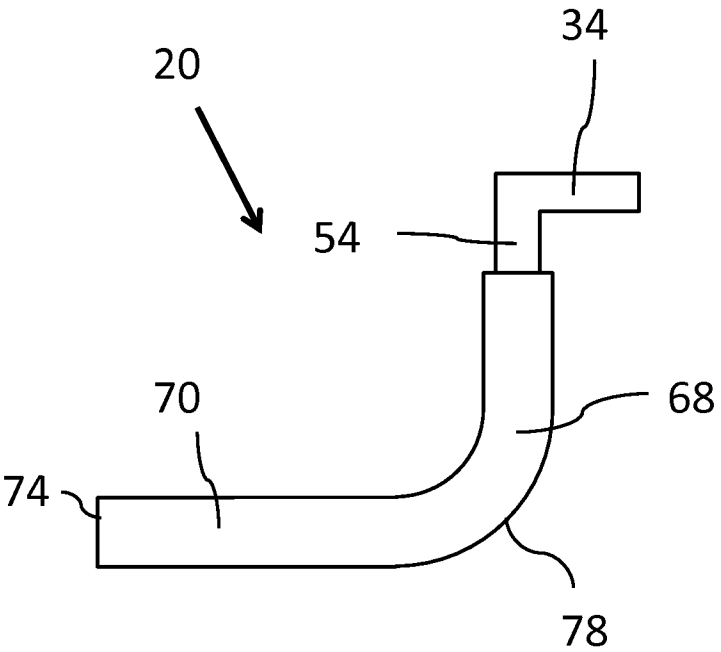
FIG. 1E is a top view of a variation of the handle of FIG. 1A.

The distal gripping portion 70 may be parallel to the proximal top, bottom, front, and back sides 34, 40, 32, 36. The gripping portion 70 may connect to the remainder of the handle at a relative sharp angle as shown at 76 in FIG. 1A, for example, or may connect at a gentle curve 78 as shown in FIGS. 1E and 1F.

Referring now to FIG. 2A, 2B, 2C, 2D, 2E, and 2F, the displayed embodiment also includes a bracket 120. In the displayed embodiment, the bracket 120 has holes 128 for using screws or other fasteners to affix the bracket 120 to wall studs, for example.

Figure 2A:
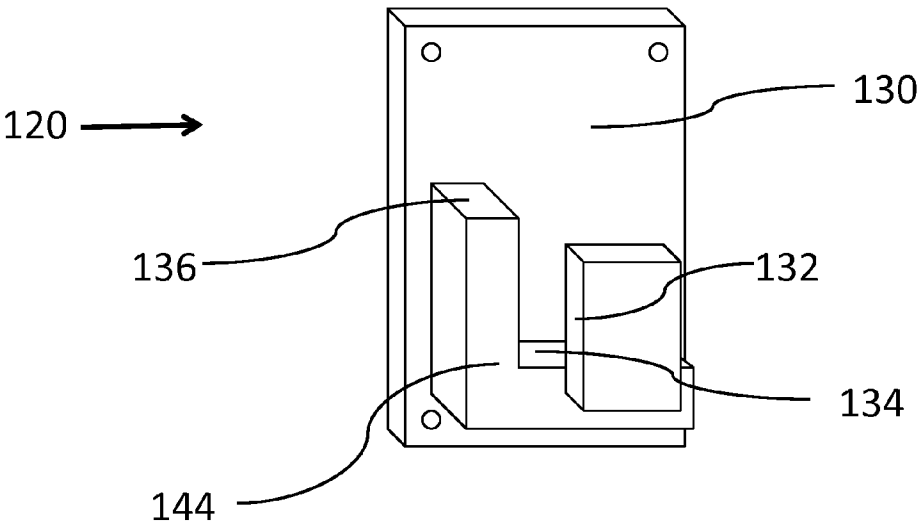
FIG. 2A is a front perspective view of the bracket portion of an embodiment of the invention.
Figure 2B:
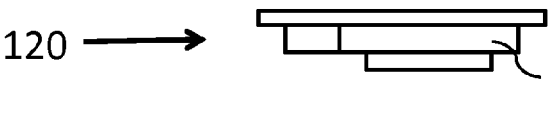
FIG. 2B is a top view of the bracket of FIG. 2A.
Figure 2C:
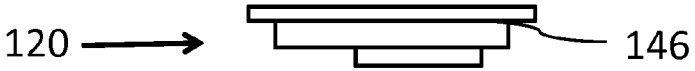
FIG. 2C is a bottom view of the bracket of FIG. 2A.
Figure 2D:
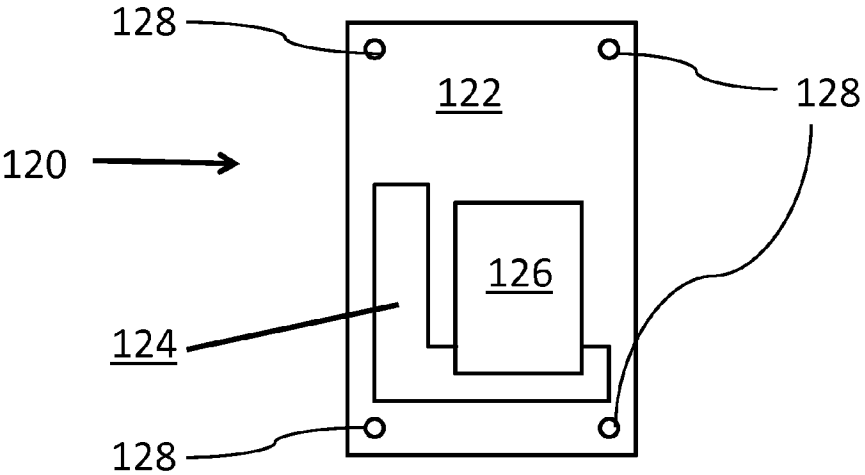
FIG. 2D is a front view of the bracket of FIG. 2A.
Figure 2F:
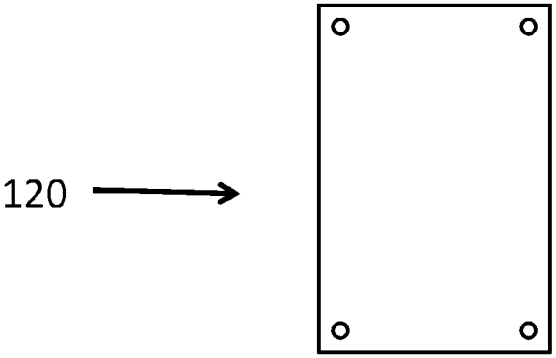
FIG. 2F is a rear view of the bracket of FIG. 2A.
Figure 2E:
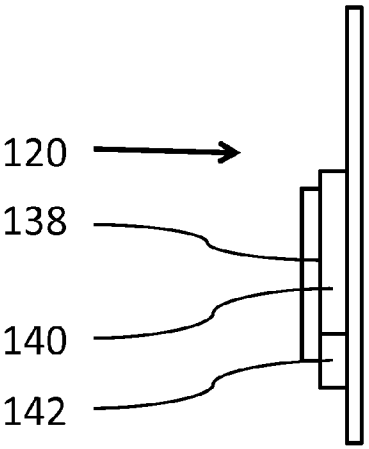
FIG. 2E is a right view of the bracket of FIG. 2A.

The bracket 120 might be cast as one piece, or can be made of three or more parts that are, for example, welded together. As shown in FIG. 2D, in this embodiment the bracket 120 includes a face plate 122, a first extension 124, and a second extension 126. The back side (not shown) of the first extension 124 is affixed to the front side 130 of the face plate 122, and the back side 138 of the second extension is affixed to the front side 144 of the first extension 124.

Figure 3A:
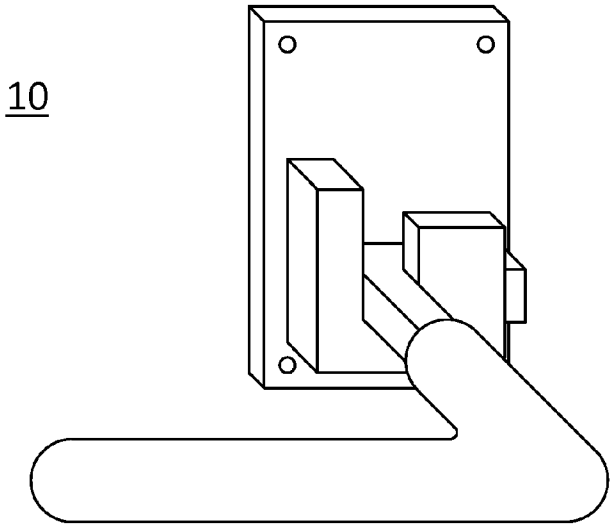
FIG. 3A is a front perspective view of an embodiment of the invention.

First extension lower top side 134 is partially located between second extension back side 138 and face plate front side 130. First extension lower top side 134 is almost exactly the same width as handle proximal bottom side 40, such that the proximal front side 32 and proximal back side 40 of the handle 20 may fit snugly against second extension back side 138 and face plate front side 130, respectively, as shown in FIG. 3A.

First extension upper right side 140 is spaced apart from second extension left side 132 so that handle left connector side 52, right connector side 56, and bottom connector side 58 fit snugly against first extension upper right side 140, second extension left side 132 and first extension lower top side 134, respectively.

Some of the adjacent parts and sides in the handle 20 and/or bracket 120 might not be at perfect right angles or perfectly parallel but instead have slight deviations. For example, the handle might be designed such that when the proximal end of the handle is perfectly horizontal, the distal end terminates at a slight upward slope, so that when downward pressure is applied to the distal end during use the distal end will remain at least parallel with the floor. Or, to create the same effect, the first and second extension might be rotated slightly clockwise on the face plate.

As another example of the elements not being at perfect right angles, the top of the second extension 126 might lean slightly outward from the face plate 122 and slope down in toward the face plate so that the proximal portion of the handle 20 can fit easily into the bracket 120 yet have the proximal front and back sides 32, 36 fit substantially snugly against the second extension back face 138 and face plate front side 130 once the handle has been completely inserted and the proximal bottom side 40 is resting against the first extension lower top side 134.

Figure 4A:
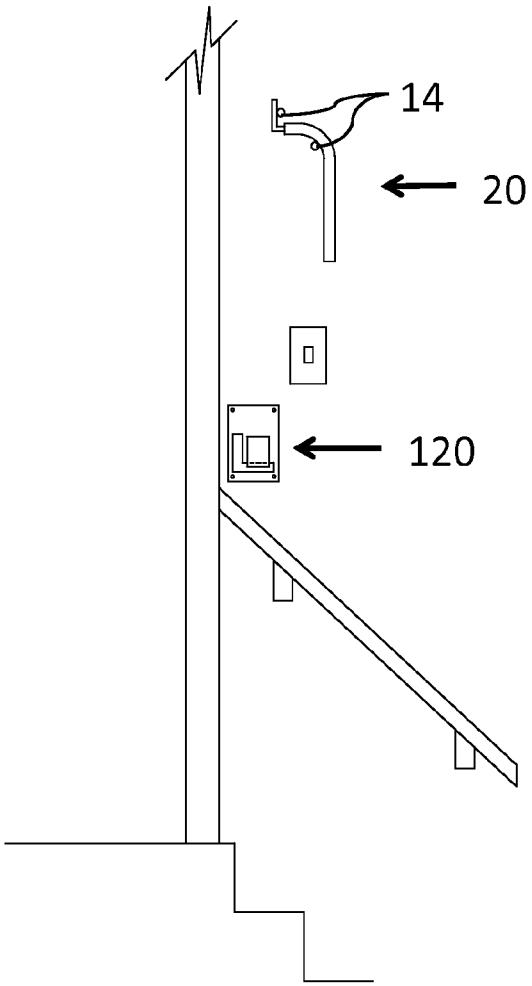
FIG. 4A shows a picture with the bracket of the embodiment of the device affixed to a wall near the top of a set of stairs, and the handle portion of the embodiment of the device hanging on two screws on said wall.
Figure 4B:
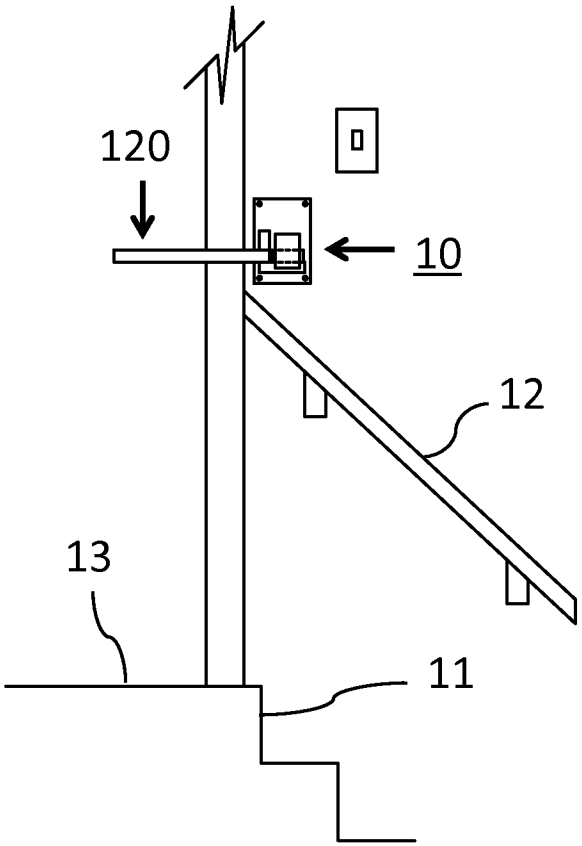
FIG. 4B shows the picture of 4A, with the handle portion of the embodiment of the invention inserted into the bracket portion of the embodiment of the invention.

FIGS. 3A and 4B display handle 20 inserted into bracket 120 for use. In this embodiment, it is assumed that bracket 120 has been affixed to a wall, as shown in FIGS. 4A and 4B, by, for example, fastening the bracket 120 to wall studs with screws through the bracket apertures 128. Bracket 120 is positioned such that when handle 20 is inserted, handle grip 70 is located so that a person ascending the stairs 11, and who can no longer use the hand rail 12 at the last step(s), may then hold on to the handle 120 while stepping on to the landing 13, as shown in FIG. 4B. Of course, a similar device 10 could be positioned at the bottom of the stairs 11 such that the gripping portion 70 of the handle would likewise be an essential extension of the handrail, reachable and usable to a user descending the stairs onto the lower floor.

As shown in FIG. 4A, when handle 20 is not in use it may be removed from bracket 120 and be hung easily on two screws 14 or other wall protrusions. Handle 20 may also be carried with the user for use in another bracket 120.

Turning now to FIGS. 3A, 3B, 3C, 3D, 3E, and 3F, it is shown how handle 20 becomes safely immobilized once the proximal and connector portions are inserted downward into the bracket 120.

Figure 3B:
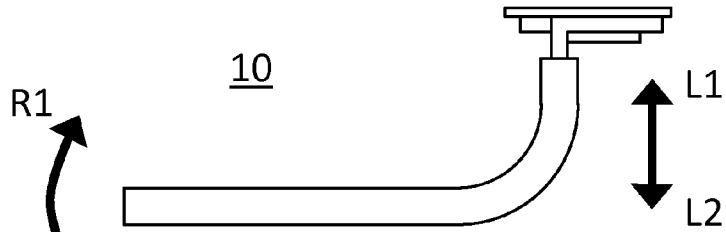
FIG. 3B is a top view of the embodiment of FIG. 3A.
Figure 3C:
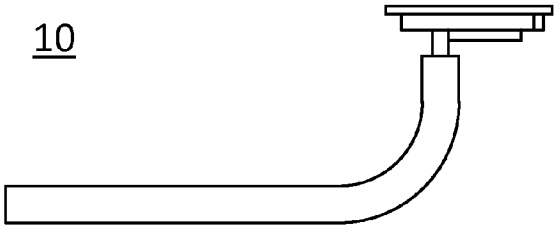
FIG. 3C is bottom view of the embodiment of FIG. 3A.

As shown in FIG. 3B, the inserted handle cannot be substantially rotated in the directions R1 and R2, and cannot be moved horizontally in the directions L1 and L2, because handle proximal front side 32 and back side 36 are positioned flat against second extension back side 138 and face plate front side 130, respectively.

Figure 3D:
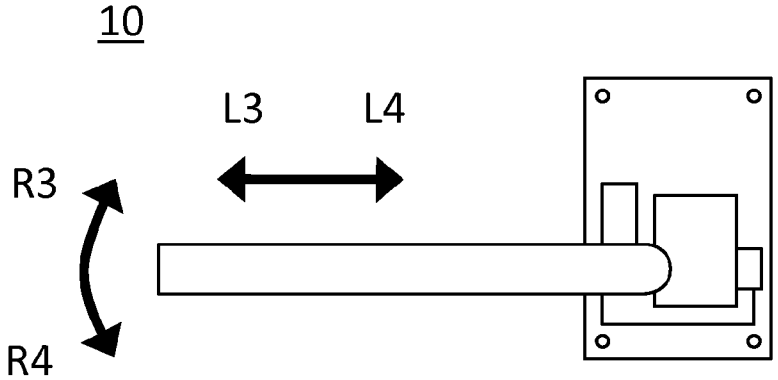
FIG. 3D is a front view of the embodiment of FIG. 3A.

As shown in FIG. 3D, the handle cannot be substantially rotated in the directions R3 and R4, and cannot be moved horizontally in the directions L3 and L4, because handle connector left side 52 and handle connector right side 56 are positioned flat against first extension upper right side 140 and second extension left side 132, respectively.

Figure 3E:
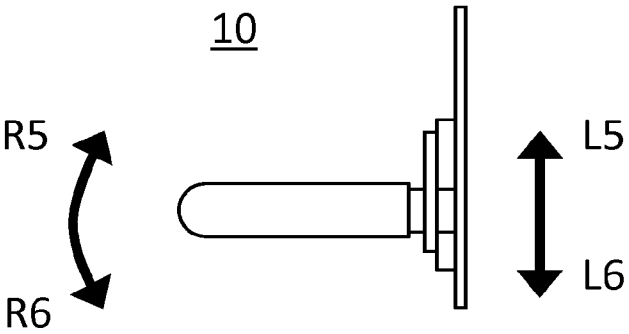
FIG. 3E is a right view of the embodiment of FIG. 3A.
Figure 3F:
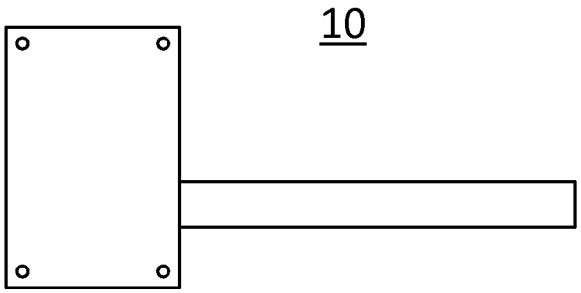
FIG. 3F is a rear view of the embodiment of FIG. 3A.

As shown in FIG. 3E, the handle cannot be substantially rotated in directions R5 and R6 because handle proximal front side 32 and back side 36 are positioned flat against second extension back side 138 and face plate front side 130, respectively.

The handle cannot be moved downward in the direction L6 because proximal bottom side 40 is resting flat against first extension lower top side 134.

Finally, the handle will not ordinarily move upward L5 because gravity is holding the handle in place. However, the handle may be removed from the bracket with relative ease by moving the handle straight upward in the direction of L5.

We claim:

1. A handrail assistance device, comprising:

a handle, wherein said handle includes a proximal portion, a connector portion, and a distal portion;

wherein said proximal portion includes a proximal top side, a proximal bottom side, a proximal front side, and a proximal back side;

wherein said proximal top and bottom sides are adjacent and perpendicular to said proximal front and back sides;

wherein said connector portion includes a connector top side, a connector left side, a connector right side, and a connector bottom side;

wherein said connector top and bottom sides are perpendicular and adjacent to said connector left and right sides;

wherein said proximal front side is adjacent and perpendicular to said connector right side;

wherein said proximal back side is adjacent and perpendicular to said connector left side;

wherein said distal portion is adjacent to said connector portion;

a bracket, wherein said bracket includes a face plate, a first extension, and a second extension;

wherein said face plate includes a front side and a back side;

wherein said first extension includes an upper right side, a lower top side, a front side, and a back side, and wherein said first extension upper right side is above, to the left of, adjacent and substantially perpendicular to said first extension lower top side;

wherein said second extension includes a back side and a left side, and wherein said second extension back side is adjacent and perpendicular to said second extension left side;

wherein said first extension back side is affixed to said face plate front side;

wherein said second extension back side is affixed to said first extension front side;

wherein said face plate front side is substantially parallel with said second extension back side;

wherein the distance between said face plate front side and said second extension back side is approximately the same as the distance between said proximal back side and said proximal front side;

wherein said first extension upper right side is substantially parallel with said second extension left side; and wherein the distance between said first extension upper right side and said second extension left side is approximately the same as the distance between said connector right side and said connector left side.

2. The device of claim 1, wherein said second extension back side includes a top and bottom, and wherein the distance between said face plate front side and the top of said second extension back side is greater than the distance between said face plate front side and the bottom of said second extension back side.

3. The device of claim 1, wherein said handle distal portion includes a distal end center, and wherein said proximal portion includes a proximal end center, and wherein said distal end center is higher than said proximal end center when said proximal bottom side is exactly horizontal and said proximal top side is above said proximal bottom side.

4. The device of claim 1, wherein said handle proximal portion further includes a proximal end side, and wherein said proximal end side is adjacent and perpendicular to said proximal top side, said proximal bottom side, said proximal front side, and said proximal back side.

5. The device of claim 1, wherein the terminal 3 inches of said handle distal portion are substantially perpendicular to said handle connector portion.

6. The device of claim 1, wherein the terminal 3 inches of said handle distal portion are substantially parallel with said handle proximal portion.

7. The device of claim 1, wherein said handle distal portion is substantially cylinder-shaped.

8. The device of claim 1, wherein said handle distal portion is covered in a foam casing.

9. The device of claim 1, wherein said first extension includes an upper top side, and wherein said first extension upper top side is adjacent and perpendicular to said first extension upper right side.

10. The device of claim 1, wherein said bracket is made of steel.

11. The device of claim 1, wherein said handle is made of steel.

12. The device of claim 1, wherein said face plate includes four apertures that define four corners of a rectangle.

13. The device of claim 1, further comprising a first screw protruding from a wall and a second screw protruding from the wall for hanging said handle, such that when said first screw is in contact with said proximal front side and said second screw is in contact with said handle approximately at where said distal portion connects with said connector portion, said distal portion is substantially perpendicular with the ground.

14. The device of claim 1, wherein said distal portion of said handle is operable to stay substantially motionless when 250 pounds of downward force are applied to said distal portion of handle when:

said proximal bottom side is in contact with and substantially parallel to said first extension lower top side, and said bracket is affixed to a substantially immovable object.

15. The device of claim 1, wherein said distal portion of handle is operable to stay substantially motionless where 250 pounds of forward force are applied to said distal portion of handle when:

said proximal back side is in contact with and substantially parallel to said face plate front side, said connector left side is in contact with and substantially parallel with said first extension upper right side, and said bracket is affixed to a substantially immovable object.

16. The device of claim 1, wherein the greatest length of said handle proximal bottom side is longer than the greatest length of said first extension lower top side.

* * * * *